US005433389A

United States Patent [19]

Laskovic et al.

[11] Patent Number: 5,433,389

[45] Date of Patent: Jul. 18, 1995

[54] METHOD AND APPARATUS FOR RECLAIMING FOUNDRY SAND

[75] Inventors: Jovo Laskovic, Schaffhausen, Switzerland; Heinz Schneble, Gailingen; Peter Rossmanith, Rielasingen, both of Germany

[73] Assignee: Georg Fischer Giessereianlagen AG, Schaffhausen, Switzerland

[21] Appl. No.: 84,939

[22] Filed: Jun. 30, 1993

[30] Foreign Application Priority Data

Jul. 1, 1992 [CH] Switzerland ..... 02063/92

[51] Int. Cl.[6] ..... B02C 19/12

[52] U.S. Cl. ..... 241/24; 241/79.1; 241/197; 241/247; 241/DIG. 10

[58] Field of Search ..... 209/288, 295, 452; 241/24, 36, 197, 247, 79.1, DIG. 10, 199.12

[56] References Cited

U.S. PATENT DOCUMENTS

| | | | |
|---|---|---|---|
| 3,756,406 | 9/1973 | Khan | 209/291 |
| 4,004,942 | 1/1977 | Richard | 134/25 R |
| 4,274,360 | 6/1981 | Hofmann et al. | 118/303 |
| 4,637,558 | 1/1987 | Jenzsch et al. | 241/79 |
| 4,681,267 | 7/1987 | Leidel et al. | 241/23 |
| 4,799,920 | 1/1989 | Mozley | 494/23 |
| 5,172,748 | 12/1992 | Satmer | 164/412 |

FOREIGN PATENT DOCUMENTS

| | | | |
|---|---|---|---|
| 0151879 | 11/1981 | Germany | 241/DIG. 10 |

*Primary Examiner*—John Husar
*Attorney, Agent, or Firm*—Bachman & LaPointe

[57] ABSTRACT

A method and apparatus for reclaiming foundry sand wherein the speed of the rotor and/or the drum and, thus, the resulting striking, shearing and friction forces are adapted or matched to the changing surface hardness of the quartz grains to be processed during the process duration. The drum comprises two drum halves separated transversely to the rotational axis, a sand inlet and a suction removal device.

15 Claims, 1 Drawing Sheet

METHOD AND APPARATUS FOR RECLAIMING FOUNDRY SAND

FIELD OF THE INVENTION

The present invention deals with a method of and apparatus for reclaiming of foundry sand.

BACKGROUND OF THE INVENTION

DE 36 42 916 C2 discloses a method of reclaiming foundry sand where the fraction containing bentonite must still be discarded.

DE 29 09 408 C2 discloses a batch drum for reclaiming of waste sand. However, such apparatus was unable to achieve a complete reclamation irrespective of the length of the process cycle.

It is therefore an object of the present invention to provide a method of and apparatus for reclaiming foundry sand, which permits shortening of the process cycle, and provides a better reclamation yield and less destruction of the quartz grain.

SUMMARY OF THE INVENTION

These and other objects of the invention, which shall become hereafter apparent, are achieved by a method of and apparatus for reclaiming foundry sand using batch processing of the foundry waste sand, so that the reclaimed sand can be utilized as core sand in the foundry or can be added into the mold sand circulation cycle as a new sand.

For this purpose, the sand is exposed in batches to high density striking friction, or shearing forces created by revolving striking mechanisms, so that the upset particles, such as bentonite, dust or organic binder sheaths which adhere to the quarts grain surface, are separated.

The amount of the force applied to the quartz grain can be achieved by controlling the rotational speed of the rotor and/or the drum. The rotational speed must be adjusted in such a way that the quartz grain is effectively cleaned, without the destruction of the grain. The adjustment of the rotational speed is effected by matching it to the surface hardness of the commodity to be reclaimed or to the changing weight per liter. The different rotational speed of the rotor and/or the drum of the reclaiming process can take into account the different grain surface hardness of 3 to 7 (according to Moh's hardness scale) during the reclaiming cycle so that a gentle, yet effective cleaning of the grain surface can be achieved.

A largely constant batch volume is necessary for the process cycle to be as short as possible. By refilling of the mold waste sand within the first five minutes, the loss of volume in the batch to be treated, which occurs at the start of the reclaiming process because of rejections of light, clayey ingredients, can be compensated.

The suctioned volume flow of the dust can be changed during the process cycle. Thus, the generated dust, the amount of which varies in the chronological time sequence, can be carried away, while the undamaged quartz grains remain.

The addition of waste sand from molds can occur for as long as the increase in weight per liter of the sand in the drum is 10% of the maximum above that of the original weight per liter.

Furthermore, the method is suitable to reprocess an at least partially thermally reheated foundry sand, that is, at least partially thermally pretreating the sand since clay-bonded as well as organically bonded binder jackets become brittle through the thermal treatment. However, they still, at least partially, adhere to the quartz grain surface. This surface can also be dedusted by application of impact, gravity and friction forces, so that the burning loss is under 0.2%. The strength of the grains produced by the reclamation is thereby increased.

An advantage of the apparatus consists in using of an opening and emptying mechanism which permits emptying of the drum during actual operation, resulting in a shortened cycle time and greater economy of the apparatus.

Another advantage of the invention is that it provides for the removal, by suction, of the starch obtained in the course of the reclamation in such a way that the various types of dust can be handled separately according to the differing composition in which they are chronologically obtained and can be directed to suitable external or internal reutilization or to a waste disposal.

Differing concentration of the component substances can also be achieved by varying the removal suction speeds during the reclaiming process.

It is thus possible to recapture the dust generated at the beginning of the reclamation process in such a way that the share of the valuable substances, such as active bentonite still contained therein, measurable by the methylene blue value, and/or carbon carriers, measurable by the burning loss in a mass portion of 60 to 80% of the entire dust generated up to this point in time, can be separately recaptured. This dust can again be directed to the mold sand of the casting process through a moistening arrangement.

It is also possible to obtain a quantity of dust at the end of a reclamation cycle, where the share of noxious substances is within the limit allowable for dumping or external use and which need not be subjected to an additional processing such as thermal processing.

A new unused foundry sand can be improved by the action of striking, shearing, and/or frictional forces. The surfaces of this product are smoothed out by the gentle influence of these forces, thereby reducing the quantities of binder used in the core fabrication shop for manufacture of cores. This is an economical, as well as an environmental advantage since the organic binders involve a waste air removal burden.

The invention is also directed to suction removal parallel to the central axis of the drums and the revolving sand flow, whereby a large cross-sectional surface can be covered with a low suction velocity.

BRIEF DESCRIPTION OF THE DRAWING

The invention will be better understood from the following Detailed Description of the Preferred Embodiment, when read with reference to the drawings, in which.

DETAILED DESCRIPTION OF THE PREFERRED EMBODIMENT

Figure 1:
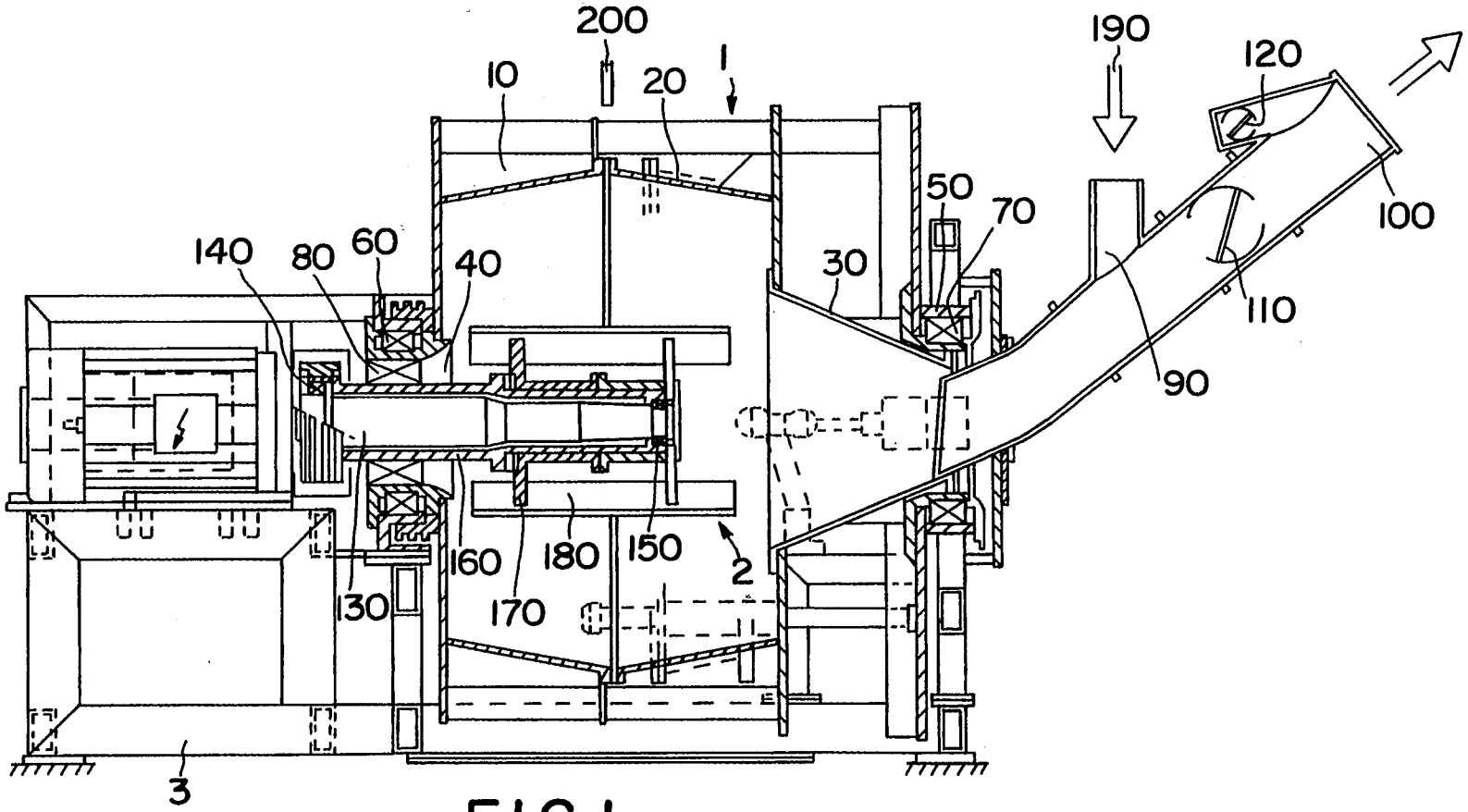
FIG. 1 is a cross-sectional view of an apparatus for reclaiming sand.

Referring now to the drawings, a batch-operating apparatus for reclaiming foundry sand is shown comprising a drum 1 and a rotor 2.

The drum 1 comprises a support structure 3 with the integrated drum consisting of two drum halves 10, 20, wherein at least one drum half 20 is axially displaceable, and a suction cone 30.

The bearing trunnions 40 and 50 are disposed at the end faces of the drum half 10 and the suction cone 30 so that the drum can rotate around the horizontal longitudinal axis. The two drum trunnions are supported in self-aligning roller bearings 60 and 70. This compensates the alignment errors between the drum and its trunnions.

The bearing on the drive side 60 is installed as a stationary bearing and the one on the sand inlet side 70 as a loose bearing. The bearing trunnion 40 is configured as a hollow shaft and is provided with an air bucket ring 80 serving as air inlet into the drum. The drum bearings are supported and attached on the machine support 3.

The drum drive is effected by an electric motor. The drum speed can be continuously adjusted by a frequency changer or converter.

The sand inlet 90 with suction stub 100 for air is inserted centrally in suction cone 30 and sealed therein. The removal by suction stub 100 is equipped with regulation flaps 110 and 120 for control of the air flow.

The rotor 2 consists essentially of a fixed support shaft 130 with bearings 140, 150 and a hollow shaft drive with a rotor member 170 installed thereon. The rotor member 170 carries several striking strips 180. The striking strips 180 are preferably provided with a clamping ring so that they can be easily replaced. The rotor is driven by an electric motor. The rotor speed can be continuously adjusted in a stepless manner by a frequency changer or converter.

The sand to be reclaimed is introduced into the reclaiming drum through a metering device 190 through the sand inlet 90 while the drum is rotating.

The air flow passing through the air bucket ring 80 is additionally made more turbulent by the rotating rotor and carries the rubbed-off valuable substances through the suction cone 30 and the suction stub 100 further to the separator.

The drum can be emptied while it is rotating. For this purpose, the axially displaceable drum half 20 is pulled away from the axially non-displaceable drum half 10 on its guides and in such a way that an outlet slot for the reclaimed products is formed between the two drum halves. The drum halves are shaped in such a way that the circumference of the vertical cross-section of the drum half facing the drum center is larger than the circumference of the vertical cross-section located at the drum's external sides. Removal of the sand with the drum halves separated by the resulting inclination of the drum jacket surface is thus assured. After several revolutions the finished reclaimed product is permitted to leave the reclamation drum. The sealing halves between the two drum halves are cleaned by air nozzles 200. Subsequently the reclamation drum is again closed. The drum is thus ready for processing the next batch. A slower rotational speed can be used while emptying the drum than is used during the reclamation operation.

The internal sides of the drum (1) may be, in accordance with the present invention, provided with a coating from a synthetic material, preferably an electrically conductive synthetic material, for protection of the internal sides from wear.

While the preferred embodiment of the invention has been described in detail, various modifications and adaptations may be made thereto without departing from the spirit and scope of the invention, as delineated in the following claims.

We claim:

1. A method for reclaiming used foundry sand comprised of quartz sand grains encased within a casing of an organic binder or the like, comprising the steps of:

providing a drum having a rotor and striking means disposed therein;

determining the surface hardness of the casing of the sand grains to be reclaimed;

loading a desired volume amount of the sand grains into said drum;

rotating at least one of said drum and said rotor at a predetermined speed in accordance with the determined surface hardness of the sand grains so as to subject the sand grains to high density striking, shearing and frictional forces; and maintaining said desired volume amount of sand in said drum for a predetermined time period.

2. A method according to claim 1 wherein the predetermined time period is at least five minutes.

3. A method according to claim 1 including thermally pretreating said sand grains prior to subjecting the sand grains to high density striking, shearing, and frictional forces so that the burning loss of the reclaimed sand is less than 0.2% and the strength of the reclaimed sand grains is increased.

4. An apparatus for reclaiming used foundry sand comprising:

a drum extending along a horizontal axis and having a first end and a second end;

a rotor rotatably mounted along said horizontal axis within said drum;

suction means mounted on said first end of said drum for removing material from said drum;

bearing means on said suction means and the second end of said drum for supporting said drum for rotation about said horizontal axis;

an air bucket ring wherein a portion of said bearing means is configured as a hollow shaft and is provided with said air bucket ring to communicate air into the drum; and means for regulating the speed of rotation of at least one of the rotor and the drum.

5. An apparatus according to claim 4 wherein internal sides of said drum are provided with a wear protection coating made of a synthetic material.

6. An apparatus according to claim 5 wherein said wear protection coating is made of a synthetic electrically conductive material.

7. An apparatus according to claim 4 further comprising means disposed at internal sides of the drum for the upward conveyance of the sand at a low rotational speed.

8. An apparatus according to claim 4 further comprising a sand inlet having a suction stub for air is centrally inserted and sealed in the suction means, said suction stub including means for controlling an air flow.

9. An apparatus according to claim 4 further comprising at least two striking strips.

10. An apparatus according to claim 9 wherein the strips are equipped with a clamping ring for the rotor.

11. An apparatus according to claim 4 wherein the suction means is disposed in such a way so as to remove the material parallel to the horizontal axis of the drum.

12. An apparatus according to claim 4, further comprising means for directing a portion of waste air originating from the drum to the drum inlet side.

13. An apparatus for reclaiming used foundry sand comprising:

a drum extending along a horizontal axis and having a first end and a second end, the drum comprises two halves wherein at least one of the drum halves is shaped so that a circumference of the vertical cross-section of the drum half facing the drum center is larger than a circumference of the vertical cross-section located at the external side of the drum so as to allow removal of the sand from the drum during rotation of the drum;

a rotor rotatably mounted along said horizontal axis within said drum;

suction means mounted on said first end of said drum for removing material from said drum;

bearing means on said suction means and the second end of said drum for supporting said drum for rotation about said horizontal axis; and means for regulating the speed of rotation of at least one of the rotor and the drum.

14. An apparatus according to claim 13 further comprising a device for cleaning sealing spaces interposed between the two drum halves.

15. An apparatus according to claim 14 wherein the device for cleaning includes air jet nozzles.

* * * * *